US009026451B1

(12) United States Patent
Kleijn et al.

(10) Patent No.: US 9,026,451 B1
(45) Date of Patent: May 5, 2015

(54) PITCH POST-FILTER

(71) Applicants: Willem Bastiaan Kleijn, Lower Hutt (NZ); Jan Skoglund, Mountain View, CA (US)

(72) Inventors: Willem Bastiaan Kleijn, Lower Hutt (NZ); Jan Skoglund, Mountain View, CA (US)

(73) Assignee: Google Inc., Mountain View, CA (US)

( * ) Notice: Subject to any disclaimer, the term of this patent is extended or adjusted under 35 U.S.C. 154(b) by 256 days.

(21) Appl. No.: 13/846,368

(22) Filed: Mar. 18, 2013

Related U.S. Application Data

(60) Provisional application No. 61/644,894, filed on May 9, 2012.

(51) Int. Cl.
*G10L 21/00* (2013.01)
*G10L 19/26* (2013.01)
*G10L 19/008* (2013.01)

(52) U.S. Cl.
CPC ..... *G10L 19/26* (2013.01); *G10L 19/008* (2013.01)

(58) Field of Classification Search
CPC ..... G10L 13/00; G10L 19/00; G06T 1/00; H03F 1/10; H04L 1/00; H04J 1/00
USPC ..... 704/500, 230, 228, 226, 219; 381/92; 375/350, 148; 348/607
See application file for complete search history.

(56) References Cited

U.S. PATENT DOCUMENTS

| | | | | |
|---|---|---|---|---|
| 6,449,590 | B1 * | 9/2002 | Gao | 704/219 |
| 6,493,665 | B1 * | 12/2002 | Su et al. | 704/230 |
| 7,424,434 | B2 * | 9/2008 | Chen et al. | 704/500 |
| 7,502,743 | B2 * | 3/2009 | Thumpudi et al. | 704/500 |
| 8,599,981 | B2 * | 12/2013 | Oshikiri | 375/350 |
| 2002/0107686 | A1 * | 8/2002 | Unno | 704/219 |
| 2004/0071197 | A1 * | 4/2004 | Lin | 375/148 |
| 2004/0156397 | A1 * | 8/2004 | Heikkinen et al. | 370/516 |
| 2005/0091046 | A1 * | 4/2005 | Thyssen et al. | 704/211 |
| 2006/0116874 | A1 * | 6/2006 | Samuelsson et al. | 704/228 |
| 2007/0055505 | A1 * | 3/2007 | Doclo et al. | 704/226 |
| 2008/0159559 | A1 * | 7/2008 | Akagi et al. | 381/92 |
| 2010/0063801 | A1 * | 3/2010 | Bruhn | 704/201 |
| 2010/0182510 | A1 * | 7/2010 | Gerkmann et al. | 348/607 |

OTHER PUBLICATIONS

S. Singhal and B. S. Atal, "Improving performance of multipulse LPC coders at low bit rates," in Proc. Int. Conf. Acoust. Speech Signal Process., San Diego, 1984, pp. 1.3.1-1.3.4.

(Continued)

*Primary Examiner* — Michael Colucci
(74) *Attorney, Agent, or Firm* — Birch, Stewart, Kolasch & Birch, LLP

(57) ABSTRACT

Methods and systems for using pitch predictors in speech/audio coders are provided. Techniques for optimal pre- and post-filtering are presented, and a general result that post-filtering is more effective than pre-filtering is derived. A practical paired-zero filter design for the low-rate regime is proposed, and this design is extended to handle frequency-dependent periodicity levels. Further, the methods described provide a general performance measure for a post-filter that only uses information available at the decoder, thereby allowing for the optimization or selection of a post-filter without increasing the rate.

10 Claims, 8 Drawing Sheets

(56) References Cited

OTHER PUBLICATIONS

V. Ramamoorthy and N. Jayant, "Enhancement of ADPCM speech by adaptive postfiltering," Bell Syst. Tech. J., vol. 63, No. 8, pp. 1465-1475, 1984.

J.H. Chen et al., "Adaptive Postfiltering for Quality Enhancement of Coded Speech", IEEE Transactions on Speech and Audio Processing, vol. 3, No. 1, Jan. 1995, pp. 59-71.

O.A. Moussa et al., "Predictive Audio Coding Using Rate-Distortion-Optimal Pre-And Post-Filtering", IEEE Workshop on Applications of Signal Processing to Audio and Acoustics, Oct. 16-19, 2011.

R. Zamir et al., "Achieving the Gaussian Rate-Distortion Function by Prediction", IEEE Transactions on Information Theory, vol. 54, No. 7, Jul. 2008, pp. 3354-3364.

S.V. Andersen et al., "Reverse Water-Filling in Predictive Encoding of Speech", IEEE, 1999, pp. 105-107.

* cited by examiner

PITCH POST-FILTER

The present application claims priority to U.S. Provisional Patent Application Ser. No. 61/644,894, filed May 9, 2012, the entire disclosure of which is hereby incorporated by reference.

TECHNICAL FIELD

The present disclosure generally relates to systems and methods for audio signal processing. More specifically, aspects of the present disclosure relate to pitch prediction in audio coders.

BACKGROUND

The output of predictive audio coders often sounds noisy when the coders operate at a low rate. While it can be shown that a post-filter is needed to reach the theoretical optimal performance, in practice it is difficult to create a post-filter that performs consistently well without causing artifacts. In addition, the performance of many existing post-filters is limited by architectural constraints.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for determining parameters of a post-filter for a segment of decoded audio, the method comprising: applying a post-filter to a segment of decoded audio; decomposing signal error for the segment of decoded audio into a signal-correlated distortion component and a signal-uncorrelated noise component; and evaluating a criterion that weighs an increase of the signal-correlated distortion component against a reduction in the signal-uncorrelated noise component.

In another embodiment the method for determining parameters of a post-filter further comprises, prior to applying the post-filter, computing the signal-correlated distortion component and the signal-uncorrelated noise component from the reconstructed signal and a hypothesized level of quantization noise.

In another embodiment the method for determining parameters of a post-filter further comprises, computing the signal-correlated distortion component and the signal-uncorrelated noise component from transmitted model parameters and a hypothesized level of quantization noise.

Another embodiment of the present disclosure relates to a method for enhancing periodicity of an audio signal, the method comprising: generating a first component by filtering an audio signal using a concatenation of a post-filter and a second filter with a gain representing a periodicity enhancement contour, said concatenation having a first delay; generating a second component by filtering the audio signal using the complement of the second filter with delay compensation matching the first delay; and computing a post-filter by adding the first component and the second component.

In one or more other embodiments, the methods described herein may optionally include one or more of the following additional features: the hypothesized level of the quantization noise is computed based on a signal-to-quantization-noise ratio; the signal-correlated distortion component and the signal-uncorrelated noise component are computed directly from the segment of decoded audio in the frequency domain; the criterion is evaluated separately for a set of frequency bands, each of the frequency bands having its own hypothesized level of quantization noise, and wherein the overall criterion is based on the criteria computed for the set of frequency bands; each of the hypothesized levels of the quantization noise is computed based on a signal-to-quantization-noise ratio; and/or the post-filter is implemented as an all-zero filter that has a pair of zeros being symmetrically placed around the midpoint of each pole of a one-tap all-pole or a virtual one-tap all-pole model of the periodicity of the signal.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
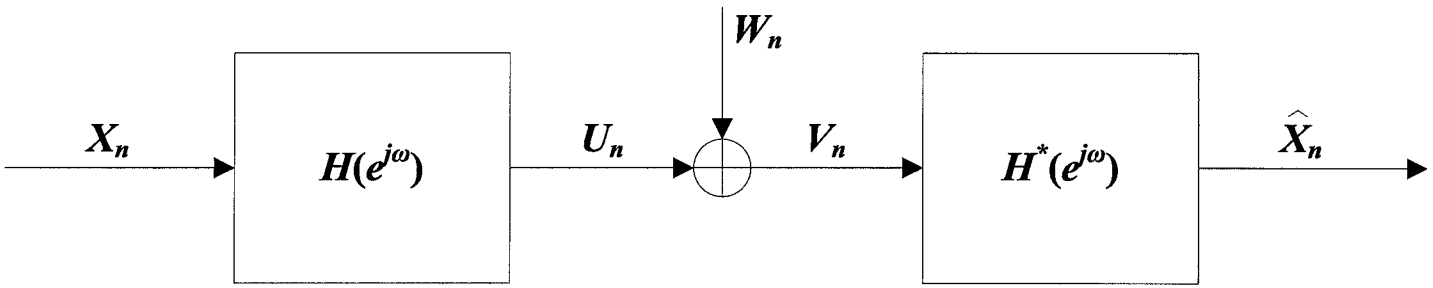
FIG. 1 is a block diagram illustrating an example predictive coding structure according to one or more embodiments described herein.

The headings provided herein are for convenience only and do not necessarily affect the scope or meaning of the claims.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples and embodiments. One skilled in the relevant art will understand, however, that the various embodiments described herein may be practiced without many of these details. Likewise, one skilled in the relevant art will also understand that the various embodiments described herein can include many other obvious features not described in detail herein. Additionally, some well-known structures or functions may not be shown or described in detail below, so as to avoid unnecessarily obscuring the relevant description.

1. INTRODUCTION

Rate-distortion (RD) optimal encoding of a stationary signal according to a squared-error criterion results, in general, in a stationary signal that has a power spectral density that differs from that of the original signal. For the stationary Gaussian (SG) signal case, the phenomenon is well understood and sometimes referred to as "reverse waterfilling."

In transform coding, reverse waterfilling does not need to be considered explicitly. Assuming a sufficiently rapid decay of the autocorrelation function, the signal is mapped to a set of white signals before quantization by a unitary transform that multiplies the signal with a banded matrix. At the decoder the inverse mapping is applied. For SG signals, the rate-distortion behavior of transform coding is well understood. An appropriate vector quantization can provide asymptotically (with block size) optimal performance and the correct spectral density of the reconstructed signal. As the coefficients are independent, the penalty for scalar instead of vector quantization is 0.254 dB at high rates.

Embodiments of the present disclosure relate to the coding of audio (e.g., speech) signals. In the context of coding speech/audio signals, a disadvantage of transform coding is that it requires a significant delay. Such delay is determined by the width of the band of the banded matrix. Particularly in applications where a direct acoustic path also exists (e.g., flight-control rooms, remote microphones for hearing-aids, etc.) and webjamming, this delay can be prohibitive. This motivates the use of predictive coding, which can operate at a much lower delay (in some instances, prediction is used only to model the signal fine structure).

While predictive coding is an effective method for coding at a low delay, its rate-distortion performance at low rate has sometimes been poorly understood. Predictive coding does not naturally provide reverse waterfilling. It is known that the squared-error performance of predictive coding is not optimal and can be enhanced by post-filtering. The relation to Wiener filtering has been cited as a motivation for the squared-error performance improvement of the post-filter. However, the Wiener filter is optimized for a clean signal contaminated with additive, statistically-independent noise, while for optimal coding of a SG signal the error signal is independent of the reconstructed signal rather than of the original signal. Indeed, Wiener filtering cannot reduce the squared error of a transform coder.

In the context of speech/audio coding, one approach suggests that a major motivation for post-filtering is perception. However, post-filtering for perceptual purposes leads, in general, to a non-optimal rate allocation of the coder. It is beneficial to separate rate-distortion optimization and processing for perception. The signal can be transformed to a domain where the coding criterion is an accurate representation of perception (the "perceptual domain"), then optimally coded (which may include pre- and/or post-filtering), and then transformed back to the acoustic domain. A simple transform pair consisting of straightforward complementary filtering is commonly used for this purpose (more complex auditory models have not been used). As will be described in greater detail herein, the present disclosure provides that perception does not need to be considered in the context of improved predictive coding.

Another approach accounts for reverse waterfilling in the context of analysis-by-synthesis predictive coding. The system under this approach was implemented for a first-order filter and the solution is approximate for low rates. It was noted that conventional post-filtering could be interpreted as an approximation of the proposed method.

A solution to optimal coding of SG signals using prediction can be based on dithered quantization. The solution is based on insight gained from the optimum test channel. The optimum test channel is a solution to the rate-distortion function and specifies a statistical mapping from the original signal to the reconstructed signal. For the SG signal, the optimal test channel implies that the original signal equals the sum of the reconstructed signal and a Gaussian noise. In other words, the channel is "backward", something that generally complicates analysis. However, the optimum test channel may also be represented in a forward form: it then is a linear filtering (pre-filtering), a noise addition, and a second linear filtering (post-filtering). A realizable structure that is asymptotically optimal is obtained if the noise addition operation is replaced by predictive dithered quantization, using the well-known fact that the quantization noise in a dithered quantizer is additive. It can then be shown that rate-distortion optimal performance can be obtained if parallel sources are encoded with one vector quantizer. It should be noted that in this case the post-filter is a Wiener filter that has the input of the quantizer as target signal.

The pre- and post-filtering scheme provides good performance also in practice. A scalar predictive entropy-constrained dithered quantizer (ECDQ) scheme with pre- and post-filtering has been found to be rate-distortion optimal for SG signals, except for a space-filling loss of 0.254 dB. A similar performance has also been shown for a special case by means of numerical optimization of pre- and post-filtering (and noise shaping) using a conventional quantizer without dither. The pre- and post-filtering scheme with dithered quantization also performs well when applied to practical (e.g., non-Gaussian) audio signals.

The good performance of pre- and post-filtered predictive coding comes at a price. For example, the filters require significant delay, particularly if the spectrum of the original signal displays spectral fine structure. A natural question is then whether at least one of the two filters can be omitted without significant loss of performance.

Embodiments and features of the present disclosure relate to improved pitch predictors for use in modeling spectral fine structure in speech/audio coders. The following description begins by deriving the general result that post-filtering is more effective than pre-filtering. This drives the conclusion that for pitch predictors, the pre-filter can be omitted to keep system delay to a minimum. Details are then provided as to the optimal pre- and post-filter configuration for the high-rate regime where no reverse waterfilling occurs. The description then presents a new practical design based on paired zeros that is aimed at the low-rate regime and can handle frequency-dependent periodicity levels. Additionally, a distortion measure is provided that allows for selecting the post-filter at the decoder. Various experiments are also outlined to show that the resulting method of the present disclosure provides significantly improved performance.

2. CODING NEARLY-PERIODIC AUDIO SIGNALS

Voiced speech often exhibits a high level of periodicity, particularly at frequencies below 1500 Hz. The periodicity can start abruptly at a voicing onset. Musical instruments can display similar behavior.

A so-called long-term predictor is commonly used to model the periodic behavior in speech in source coding. The prediction filter generally has a single tap, at the pitch period (delay), P. The single tap is often generalized to facilitate fractional delay. While fractional delay is not discussed explicitly, the solutions discussed below generalize to this case.

The following section derives some results relevant for pitch post-filtering. The results described below assume SG signals. Section 3, below, derives the optimal pre- and post-filter for the conventional pitch predictor for the high-rate regime. As pitch pre- and post-filters may require significant delay, it is useful to consider the situation where only a pre- or a post-filter is used. Section 3.1 derives a general result that a post-filter is more effective than a pre-filter. This is particularly relevant for pitch prediction as the pre- and post-filters each require significant delay.

3. PITCH PREDICTOR AND OPTIMAL PRE- AND POST-FILTERING

For simplicity, consider a process $X_n$ that has a flat spectral envelope that is encoded using a generalized single-tap pitch predictor (section 4 describes how this applies to practical signals). The pitch predictor models the signal as an autoregressive (AR) process with power spectral density $$S_X(e^{j\omega}) = \frac{\sigma^2}{|1-\alpha e^{-j\omega P}|^2}, \tag{1}$$

where $\alpha>0$ is a real coefficient $\sigma^2$ and determines the signal power. The spectral density provided by equation (1) is periodic with fundamental frequency $2\pi/P$.

Consider the optimal coding of the AR process of equation (1). Let $\lambda\geq 0$ represent the so-called water level that determines the coding rate and distortion. The distortion is $$D(e^{j\omega}) = \begin{cases} \lambda, & \lambda \leq S_X(e^{j\omega P}) \\ S_X(e^{j\omega P}), & \text{elsewhere} \end{cases}. \tag{2}$$

If the condition $\lambda\leq S_X(e^{j\omega P})$ is true for all $\omega$ (e.g., the system operates in the high-rate regime), then the power spectral density $S_X$ can be realized with a realizable rational filter.

Optimal performance can be obtained with a predictive coding structure that uses ideal pre- and post-filters and ECDQ. FIG. 1 outlines the basic configuration of such a predictive coding structure. The absolute response |H| for the ideal pre- and post-filters is $$|H(e^{j\omega})|^2 = 1 - \frac{D(e^{j\omega})}{S_X(e^{j\omega})}. \tag{3}$$

The phase response of the pre-filter may be arbitrary but the response of the post-filter should be the complex conjugate of the response of the pre-filter.

For the one-tap predictor of equation (1), the response in equation (3) becomes $$|H(e^{j\omega})|^2 = \begin{cases} 1 - \frac{\lambda}{\sigma^2}(1+\alpha^2 - 2\alpha\cos(\omega P)), & \lambda \leq S_X(e^{j\omega P}) \\ 0, & \text{elsewhere} \end{cases}. \tag{4}$$

The absolute response |H| as given by equation (4) has maxima at $$\omega = \frac{n2\pi}{P}, n \in Z;$$

the gain at the maxima is near unity for $\alpha\approx 1$. As is shown in Appendix A below, for the high-rate regime $\lambda\leq S_X(e^{j\omega P})$, $\lambda\leq S_X(e^{j\omega P})$, $\forall\omega\in[-\pi,\pi]$, the frequency response $H(e^{j\omega})$ can be implemented exactly with an all-zero filter with its zeros at $$\omega = \frac{\pi + n2\pi}{P} n \in Z.$$

For the low-rate regime, the response in equation (4) does not have a practical analytic solution. Section 4, which will be described in greater detail below, provides an approximate solution that performs well in practice.

3.1. Effect of Removing Pre- or Post-Filtering

As the pre- and post-filters introduce delay, and as it is natural to use only a post-filter in scenarios where an existing coder is used (for backward compatibility), considered herein is the effect of omitting either the pre- or post-filter. For mathematical expediency, considered is a SG process and a general predictive coder with infinite-order predictor. The pre- and post-filters are those optimized for the case that both exist. This assumption differs from an existing approach which optimizes the pre-filter numerically with knowledge of the post-filter (including the case where the post-filter is the identity operation). First considered is the coding operation including both pre- and post-filtering. The first step is the pre-filtering operation with output $U_n$. From equation (3), presented above, it is understood that the pre-filtered signal has a power-spectral density $$S_U(e^{j\omega}) = \left(1 - \frac{D(e^{j\omega})}{S_X(e^{j\omega})}\right) S_X(e^{j\omega}). \tag{5}$$

Assume the filter to have zero phase. The signal distortion $X_n - U_n$ in $U_n$ then has power spectral density $$S_{X-U}(e^{j\omega}) = 2\left(1 - \sqrt{1 - \frac{D(e^{j\omega})}{S_X(e^{j\omega})}}\right) S_X(e^{j\omega}) - D(e^{j\omega}). \tag{6}$$

Figure 2:
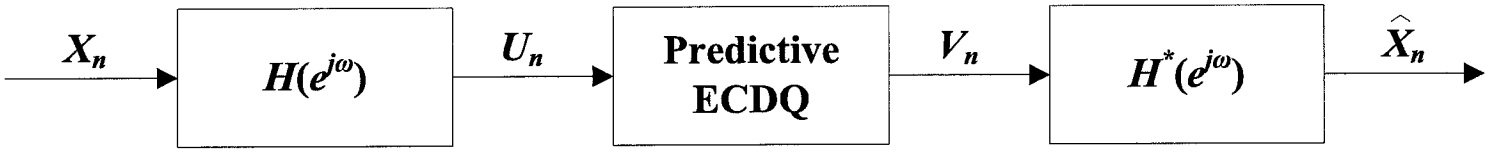
FIG. 2 is a block diagram illustrating an example forward test channel equivalent of a predictive coding structure according to one or more embodiments described herein.

The pre-filtered signal $U_n$ is subjected to the predictive dithered quantizer, which adds white quantization noise $W_n$ with a power spectrum $\lambda$, assuming the predictor is optimal for the noisy output of the dithered quantizer. Under these conditions, the predictive ECDQ of FIG. 1 is equivalent to the forward test channel shown in FIG. 2. As the quantization noise $W_n$ is independent from the signal $X_n$, the output $V_n$ of the dithered quantizer has an error power spectral density $$S_{X-V}(e^{j\omega}) = 2\left(1 - \sqrt{1 - \frac{D(e^{j\omega})}{S_X(e^{j\omega})}}\right)S_X(e^{j\omega}) - D(e^{j\omega}) + \lambda \quad (7)$$

$$\geq 2\left(1 - \sqrt{1 - \frac{D(e^{j\omega})}{S_X(e^{j\omega})}}\right)S_X(e^{j\omega}). \quad (8)$$

Note that for small $$\frac{D(e^{j\omega})}{S_X(e^{j\omega})},$$

equation (8) converges to $D(e^{j\omega})$. For regions where $S_X(e^{j\omega})=0$ the error spectral density is $\lambda-D(e^{j\omega})=\lambda-S(e^{j\omega})=\lambda$.

The output $V_n$ of the predictive dithered quantizer consists of two independent components: the signal component $U_n$ with power spectral density $S_U(e^{j\omega})$ and the noise component $W_n$ with power spectral density $\lambda$. After post-filtering, the estimated signal $\hat{X}_n$ is obtained. It has a signal component that has power spectral density $$S_X(e^{j\omega})\left(1 - \frac{D(e^{j\omega})}{S_X(e^{j\omega})}\right)^2$$

and a signal component distortion spectral density $$S_X(e^{j\omega})\frac{D(e^{j\omega})^2}{S_X(e^{j\omega})^2}.$$

The noise component is attenuated to have an output power spectral density $$\lambda\left(1 - \frac{D(e^{j\omega})}{S_X(e^{j\omega})}\right) = D(e^{j\omega})\left(1 - \frac{D(e^{j\omega})}{S_X(e^{j\omega})}\right) \quad (9)$$

$$= D(e^{j\omega}|) - \frac{D(e^{j\omega})^2}{S_X(e^{j\omega})}, \quad (10)$$

where it is exploited in equation (9) that $$\left(1 - \frac{D(e^{j\omega})}{S_X(e^{j\omega})}\right)$$

vanishes whenever $D(e^{j\omega})$ is not equal to $\lambda$. The sum of the signal distortion and the noise component in the output is therefore $$S_{X-\hat{X}}=D(e^{j\omega}). \quad (11)$$

An analysis may then be performed for the pre-filter being omitted. To indicate the omission of the pre-filter, the output of the predicted ECDQ is denoted by $\hat{V}_n$ and the output of the post-filter by $\tilde{\hat{X}}$. It is assumed that the predictor is optimal for the noisy output of the dithered quantizer. The output of the dithered quantizer is now $S_X(e^{j\omega})+\lambda$, with the signal and noise components being independent. The signal component of the post-filter output $\tilde{\hat{X}}_n$ is identical to the process $U_n$ defined in an earlier section above, and the noise component has a spectral density given by equation (10). The spectral density of the error signal $X_n-\tilde{\hat{X}}_n$ is then $$S_{X-\tilde{\hat{X}}}(e^{j\omega}) = 2\left(1 - \sqrt{1 - \frac{D(e^{j\omega})}{S_X(e^{j\omega})}}\right)S_X(e^{j\omega}) - \frac{D(e^{j\omega})^2}{S_X(e^{j\omega})}. \quad (12)$$

For small $$\frac{D(e^{j\omega})}{S_X(e^{j\omega})},$$

equation (12) converges to $D(e^{j\omega})$ from below, indicating that, in accordance with embodiments of the present disclosure, the omission of the pre-filter does not affect performance at high rate. For regions where $S_X(e^{j\omega})=0$ the error vanishes. Comparing equations (8) and (12), it is seen that for equal quantization noise variance $\lambda$, the post-filter only always performs better than the pre-filter only. However, the rate required for the not pre-filtered signal is higher, relatively more so for low rates.

It should be noted that the error spectral density of equation (12) is, in fact, lower than the error spectral density $D(e^{j\omega})$ in the optimal case. This is a result of the fact that the signal component is error free prior to being processed by the post-filter. However, also in the optimal case the rate for the same quantization error is lower than that of the post-filter only case. This more than compensates for the reduced error.

Consider the rates required for the pre-filtered case and the case without a pre-filter. The rate for the not pre-filtered case follows from earlier theorems, and the assumption that the signal and the quantization noise are Gaussian:

$$I(U_n; V_n) = \frac{1}{4\pi}\int_{-\pi}^{\pi}\log\left(\frac{S_X(e^{j\omega})+\lambda}{\lambda}\right)d\omega, \quad (13)$$

while the rate for the pre-filtered case is $$I(U_n; V_n) = \frac{1}{4\pi}\int_{-\pi}^{\pi}\log\left(\frac{\max(S_X(e^{j\omega}), \lambda)}{\lambda}\right)d\omega. \quad (14)$$

The cost and benefit of switching from a system with a pre-filter to a system with a post-filter is now known. If the rate-increase distortion-decrease ratio of the switch is lower than the average slope of the rate-distortion relation for the pre-filter only case over this interval, then it is beneficial to make the switch. Starting from the no pre-filter only case, the distortion is $\lambda$. The relevant rate-distortion relation is given by equation (14) and it is immediately seen that the rate-distortion slope is $$\frac{1}{2\lambda}$$

nats. The rate can be increased so the average rate is over the distortion decrease interval is larger. This implies that if the ratio of the increase in rate divided by the decrease in distortion is less than $$\frac{1}{2\lambda},$$

then a post-filter is beneficial over a pre-filter.

The ratio of the excess rate for the post-filter only case and excess distortion for the pre-filter only case can be evaluated on a per radians basis. The excess rate per radians $R_{excess}(e^{j\omega})$ for the not pre-filtered case over the pre-filtered case (which is identical to the optimal case) is:

$$R_{excess}(e^{j\omega}) = \frac{1}{2}\left(\log\left(\frac{S_X(e^{j\omega})+\lambda}{\lambda}\right) - \max\left(0, \log\left(\frac{S_X(e^{j\omega})}{\lambda}\right)\right)\right). \tag{15}$$

Similarly, from equations (7) and (12) it follows that the excess distortion is:

$$D_{excess}(e^{j\omega}) = -D(e^{j\omega}) + \lambda + \frac{D(e^{j\omega})^2}{S_X(e^{j\omega})}. \tag{16}$$

The ratio of the excess rate per radians for the post-filtered case over the excess distortion per radians for the pre-filtered case is then $$\frac{R_{excess}(e^{j\omega})}{D_{excess}(e^{j\omega})} = \frac{\log\left(\frac{S_X(e^{j\omega})+\lambda}{\lambda}\right) - \max\left(0, \log\left(\frac{S_X(e^{j\omega})}{\lambda}\right)\right)}{2\left(-D(e^{j\omega}) + \lambda + \frac{D_X(e^{j\omega})^2}{S_X(e^{j\omega})}\right)}. \tag{17}$$

For the high-rate case, equation (17) simplifies to:

$$\frac{R_{excess}(e^{j\omega})}{D_{excess}(e^{j\omega})} = \frac{\log\left(1 + \frac{\lambda}{S_X(e^{j\omega})}\right)}{2\lambda\frac{\lambda}{S_X(e^{j\omega})}}. \tag{18}$$

Note that equation (18) converges monotonically from bit $$\frac{1}{2\lambda}$$

per radians at the low-rate high-rate regime boundary $$(S_X(e^{j\omega}) = \lambda) \text{ to } \frac{1}{2\lambda}$$

nats/radians with increasing rate. Thus, in the high-rate regime a post-filter is better than a pre-filter, but the benefit decreases with increasing rate. This is natural because at high-rate pre- and post-filters asymptotically become the identity operation.

For the low-rate case, equation (17) simplifies to:

$$\frac{R_{excess}(e^{j\omega})}{D_{excess}(e^{j\omega})} = \frac{\log\left(\frac{S_X(e^{j\omega})+\lambda}{\lambda}\right)}{2\lambda}, \tag{19}$$

which converges monotonically to zero with decreasing rate (increasing $\lambda$) from a value of $$\frac{1}{2\lambda}$$

bits per radian at the low-rate high-rate regime boundary ($S_X(e^{j\omega})=\lambda$). This result is intuitive as the rate converges to zero when the energy of the original signal is zero and the cost in rate of having a post-filter instead of a pre-filter vanishes asymptotically.

The main result from the above section may be described as the following (which may be referred to herein as "Theorem 1"): consider the encoding and decoding of a stationary Gaussian process with an optimal predictive ECDQ quantizer that produces Gaussian quantization noise with variance $\lambda$. Let the pre- and post-filters be defined by equation (3) and have zero phase. Then the ratio of the rate increase and the distortion reduction of using only a post-filter instead of only a pre-filter is never more than $$\frac{1}{2\lambda}.$$

A corollary of Theorem 1 is that if the filters are restricted to be of the form of equation (3) and have zero phase then post-filtering is more effective than pre-filtering. This is consistent with various experimental results. In general, the more "peaky" the spectral density, the larger the advantage of using a post-filter over a pre-filter. This follows from the fact that both equations (19) and (18) are concave in $S_X$. As the fine-structure of speech is particularly "peaky", pitch post-filtering is likely to be significantly more beneficial than pitch pre-filtering.

4. EXAMPLE PITCH POST-FILTER DESIGN

In the previous section described above (section 3.1) it was shown, under certain assumptions, that if only a pre-filter or a post-filter is to be used, then it is better in terms of mean-squared error performance to use a post-filter. Section 3, also discussed previously, derived the optimal pre- and post-filter for the conventional pitch predictor, which corresponds to an implementable all-zero filter (shown in appendix A) in the high-rate regime $S_X(e^{j\omega})>\lambda$, $\forall\omega\in[-\pi,\pi]$.

In practice, a pitch predictor is generally operated in the low-rate regime and $S_X(e^{j\omega})<\lambda$ for finite intervals of $\omega$. In contrast to the high-rate regime, no finite-delay filter representation exists for the low-rate regime and an appropriate approximate solution must be used. In section 4.1, below, a particular practical solution is described in accordance with one or more embodiments of the present disclosure. As will be further described below, the solution may be extended to include the case where the periodicity of the signal is frequency-dependent.

It should also be noted that in some cases it may be desirable to add a post-filter to a legacy coding structure. It also may be desirable not to emphasize signal misestimates. Furthermore, it may be beneficial to define a measure of goodness for the post-filter that can be used at the decoder. In section 4.2, below, a criterion is defined that trades-off signal distortion versus noise removal, and using knowledge only of the decoded signal and coder signal to noise ratio.

4.1 A Flexible Post-Filter Design

In accordance with one or more embodiments, the optimal response of pre- and post-filter given by equation (4) may be implemented by an all-zero structure of the form:

$$A_{ltpf}(z,\beta_0,\beta_1)=\beta_0(1+\beta_1 z^{-P}), \tag{20}$$

where P is the pitch delay in samples (as before, the logic generalizes to fractional delay pitch).

It should be noted that the filter of equation (20) has two significant drawbacks. First, it is not valid for the low-rate regime ($S_X(e^{j\omega})<\lambda$ for finite intervals of $\omega$), which is the normal operating mode for pitch predictors. Second, most audio signals vary in periodicity level with frequency. With the introduction of the pitch post-filter, and resulting improved modeling, an incorrect modeling of the signal's periodicity becomes more prominent. Accordingly, a post-filter that alleviates both disadvantages will be described in detail below.

Consider the real filter coefficient $\beta_1$. Rotating this coefficient by $e^{P\omega_0}$ results in the following:

$$A_{ltpf}(z,\beta_0,e^{P\omega_0}\beta_1)A_{ltpf}(z,\theta)=\beta_0(1+e^{P\omega_0}\beta_1 z^{-P}). \tag{21}$$

While the corresponding filter now results in complex output, it can be used as a building block for a filter with real output. Consider the concatenation of two filters: one where the zeros are rotated in the clockwise, and one where the zeros are rotated counterclockwise by the same amount. It is noted that $$A_{ltpf}(z,\beta_0,e^{P\omega_0}\beta_1)^*=A_{ltpf}(z,\beta_0,e^{-P\omega_0})\beta_1). \tag{22}$$

Figure 3:
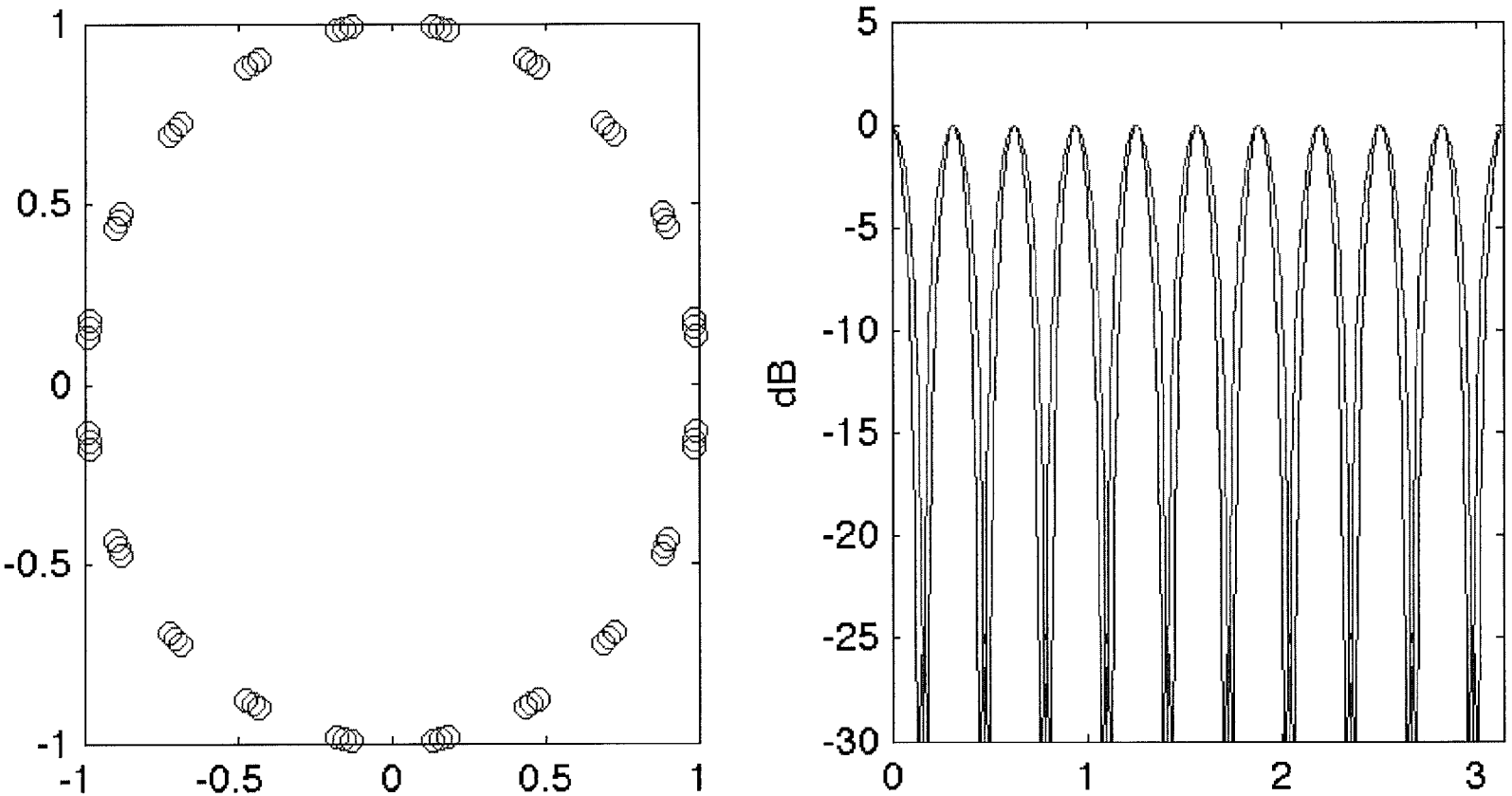
FIG. 3 is a graphical representation illustrating example results and responses of a paired-zero pitch post-filter according to one or more embodiments described herein.

The filter $$B_{ltpf}(z,\beta_0,e^{P\omega_0}\beta_1)=A_{ltpf}(z,\sqrt{\beta_0},e^{-P\omega_0}\beta_1)A_{ltpf}(z,\sqrt{\beta_0},e^{P\omega_0}\beta_1) \tag{23}$$

is real, has the same maximum gain as the filter $A_{ltpf}(z, \beta_0, e^{P\omega_0}\beta_1)$, but has broader valleys. An example of the resulting z-plane and frequency response is shown in FIG. 3. The broader valleys approximate the intervals where the response of equation (4) is zero for the low-rate regime.

The parameters of the filter of equation (23) may be determined with different approaches, including the following:

1. To maximize the similarity to the optimal filter by making it maximally similar to the response in equation (4). It is then natural to set $\beta_1=1$ and to find $\omega_0$. An exact analytic solution appears intractable, but a numerical solution is easy to find with a line search.

2. To minimize directly the expected reconstructed signal error, given the signal model. Since ECDQ is used, the resulting post-filter is a constrained Wiener filter. While this method is not entirely consistent with the logic that led to the filter of equation (23), this method can be expected to provide good performance. The derivation of the optimal coefficients are provided in Appendix B.

3. The method of item 2, above, but where the filter of equation (23) is matched to the empirical data directly rather than to the signal model. An appropriate criterion based on the decoded signal is defined in section 4.2 below. The main advantage of this method is that it does not emphasize modeling errors.

4. To select the optimal parameters from a pre-defined set using a decoded signal based performance criterion. An appropriate criterion is defined in section 4.2 below. A first advantage of this approach is that it is independent of the functional complexity of post-filter. A second advantage is that it does not emphasize modeling errors.

A filter with an appropriate frequency-dependent gain may be obtained by mixing the filter of equation (23) and a unit-response filter with a gain of $\beta_0$ (in practice a delay is also required). Let $H_{1p}(z, \mu)$ be a linear-phase low-pass filter with one adjustable parameter $\mu$ and a unity gain at $\omega=0$. The complementary high-pass filter is then $1-H_{1p}(z, \mu)$. This enables for creation of a long-term post-filter with frequency-varying periodicity by creating the following filter:

$$G(z)=B_{ltpf}(z,e^{M\omega_0}\theta)H_{1p}(z,\mu)+\beta_0(1-H_{1p}(z,\mu)) \tag{24}$$

Figure 4:
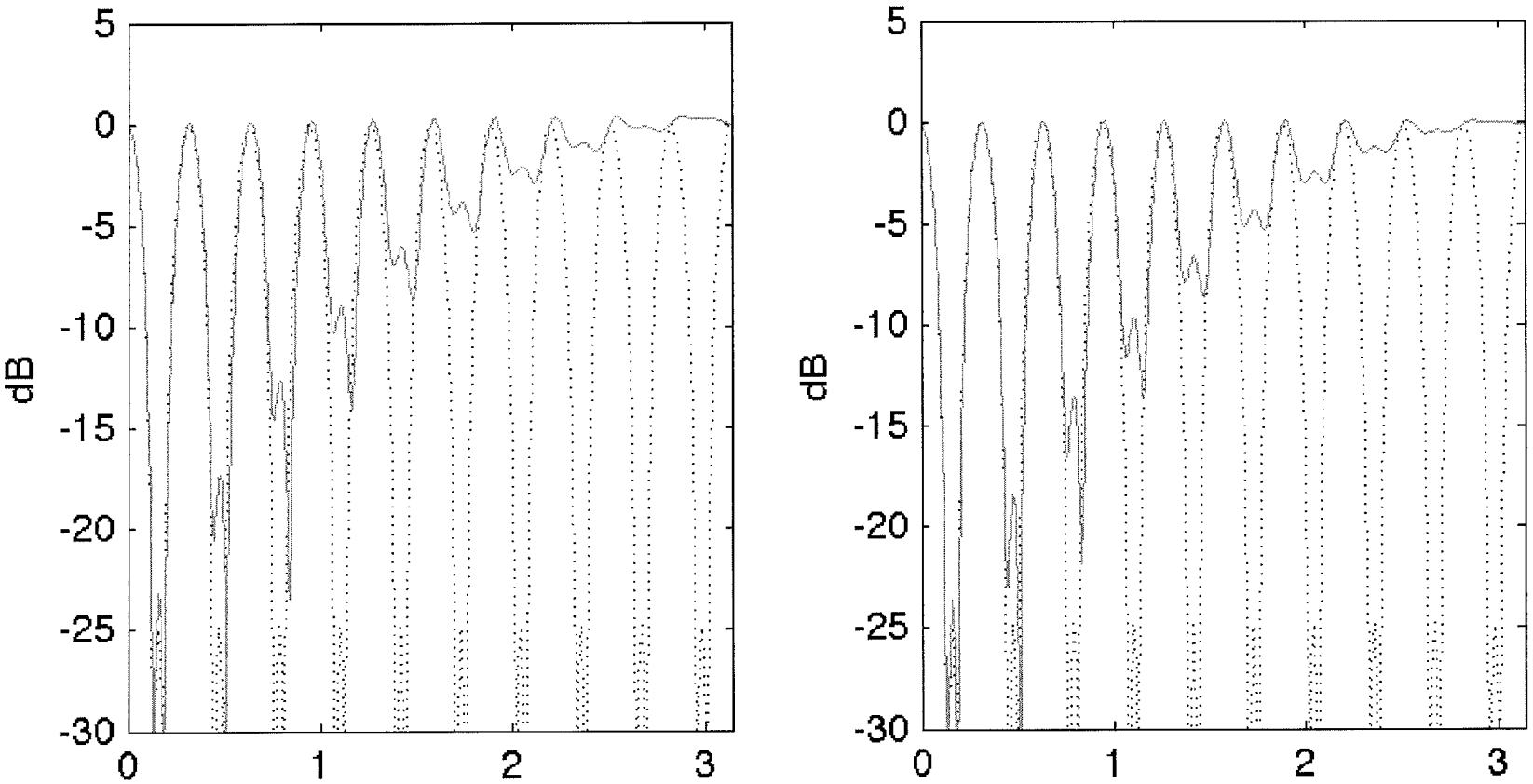
FIG. 4 is a graphical representation illustrating example filter responses of a paired-zero pitch post-filter according to one or more embodiments described herein.

FIG. 4 shows two examples of filters designed in the above-manner (according to equation (24)). An analytic solution to the simultaneous optimization of the filter $H_{1p}(z, \mu)$ and $B_{ltpf}(z, e^{M\omega_0}\theta)$ is cumbersome. In practice a selection from a fixed set of pre-defined filters is used with the criterion that is discussed below in section 4.2, and as described in item 4 above. Either filters G(z) can be pre-defined, or $B_{ltpf}(z, e^{M\omega_0}\theta)$ can be optimized from a uniform signal model and a selection of the filter $H_{1p}(z, \mu)$ be made from a pre-defined set.

4.2 Decoder-Based Performance Measure

As was described above in section 4.1, using the signal model to determine the pre- and post-filters may emphasize any modeling errors. Particularly for the post-filter only scenario, it is possible to select the parameter settings based directly on the output of the predictive ECDQ before the pre-filter. In the following section it is assumed that the power spectral density of the output of the predictive ECDQ, $S_{\tilde{Y}}(e^{j\omega})$, and the quantization noise variance $\lambda$ are known. In practice this means that the post-filter parameters can be estimated at the decoder. It is straightforward to extend the method for quantization noise that is not spectrally flat. The criterion is general and applies to any type of post-filter.

Using the fact that a predictive ECDQ results in additive quantization noise, its output spectral density $S_{\tilde{Y}}(e^{j\omega})$ can be split into a signal contribution $S_X(e^{j\omega})=S_{\tilde{Y}}(e^{j\omega})-\lambda$ and a noise contribution $\lambda$. It should be noted that in existing coders, these contributions are considered of equal importance; however, in accordance with the present disclosure, this is not necessarily correct from a perceptual viewpoint. Let the frequency response of the post-filter be $f(e^{j\omega}, \theta)$ with parameters $\theta$. The filter typically satisfies $0|f(e^{j\omega})|^2\leq 1$, $\forall\omega\in[-\pi,\pi]$. To determine the optimal $\theta$ the total squared error is minimized by the following:

$$\hat{\theta}=\underset{\theta}{\operatorname{argmin}}\frac{1}{2\pi}\int_{-\pi}^{\pi}|1-f(e^{j\omega},\theta)|^2(S_{\tilde{Y}}(e^{j\omega})-\lambda)d\omega+\frac{\lambda}{2\pi}\int_{-\pi}^{\pi}|f(e^{j\omega},\theta)|^2 d\omega \tag{25}$$

$$=\underset{\theta}{\operatorname{argmin}}\frac{1}{2\pi}\int_{-\pi}^{\pi}|1-f(e^{j\omega},\theta)|^2\left(\frac{S_{\tilde{Y}}(e^{j\omega})}{\lambda}-1\right)d\omega-\frac{1}{2\pi}\int_{-\pi}^{\pi}|f(e^{j\omega},\theta)|^2 d\omega \tag{26}$$

In equation (26), the first term describes the distortion of the original signal introduced by the post-filter and the second term is a measure of noise removal by the post-filter (note that it is not the remaining noise).

Note that if f is real (as it would be for an optimal Wiener filter), then $|1-f|^2$ is concave and $|f|^2$ is convex. This implies that at low attenuation levels f~1 the distortion term is relatively small, whereas the noise removal term is relatively large. As a result, spectral regions without spectral structure may affect the filter selection process. This effect can be reduced with a heuristic power coefficient. Additionally the differences in perception of the two components can be accounted for as follows:

$$\hat{\theta}' = \underset{\theta}{\operatorname{argmin}} \frac{1}{2\pi}\int_{-\pi}^{\pi} |1 - f(e^{j\omega}, \theta)|^{\xi}\left(\frac{S_{\hat{V}}(e^{j\omega})}{\lambda} - 1\right) d\omega - \frac{b}{2\pi}\int_{-\pi}^{\pi} 1 - |f(e^{j\omega}, \theta)|^{\xi}\, d\omega \tag{27}$$

where $\xi$ is suitably chosen in the range $1 \le \xi \le 2$, and where b accounts for differences in perception between the two components.

An important property of equations (26) and (27) is that they favor post-filters with a structure similar to the signal over post-filters with a structure different from the signal. This is a direct result of the form of the first term. For pitch prediction this implies that if the signal $S_{\hat{V}}(e^{j\omega})$ does not display a harmonic structure in some region, then a post-filter with no periodicity enhancement is favored.

A particular focus of the present disclosure is pitch prediction. Thus far, a basic assumption has been that the spectral envelope of the signal is flat and that only the spectral fine-structure needs to be considered. It should be noted that if $S_{\hat{V}}(e^{j\omega})$ is underestimated for any reason, then the criterion will tend toward favoring periodicity enhancement even if the signal is not periodic. This practical problem can be prevented by considering frequency bands separately and ensuring that the overall signal-to-noise ratio is reasonable in each band. The total criterion is then a weighted average of the bands. It is also noted that it is computationally expensive to select the pitch using the procedure described in this section. In practice it is advantageous to determine the pitch structure for $f(e^{j\omega}, \theta)$ separately.

5. EXPERIMENTAL RESULTS

To illustrate and confirm the above descriptions of Sections 3 and 4, results of experiments for both artificial data and for speech signals will now be provided.

5.1. Performance on Artificial Data

Experiments were performed on an AR process with a spectrum given by equation (1) using a forward test-channel simulating predictive entropy-constrained dithered quantization. The process parameters selected for this example were P=80, $\alpha$=0.97, and $\sigma$=5. The experimental results were obtained through averaging multiple realizations of the process, with all-zero pre-filters and/or post-filters as described in previous sections, and quantization simulation through adding noise with different levels $\lambda$.

Figure 5:
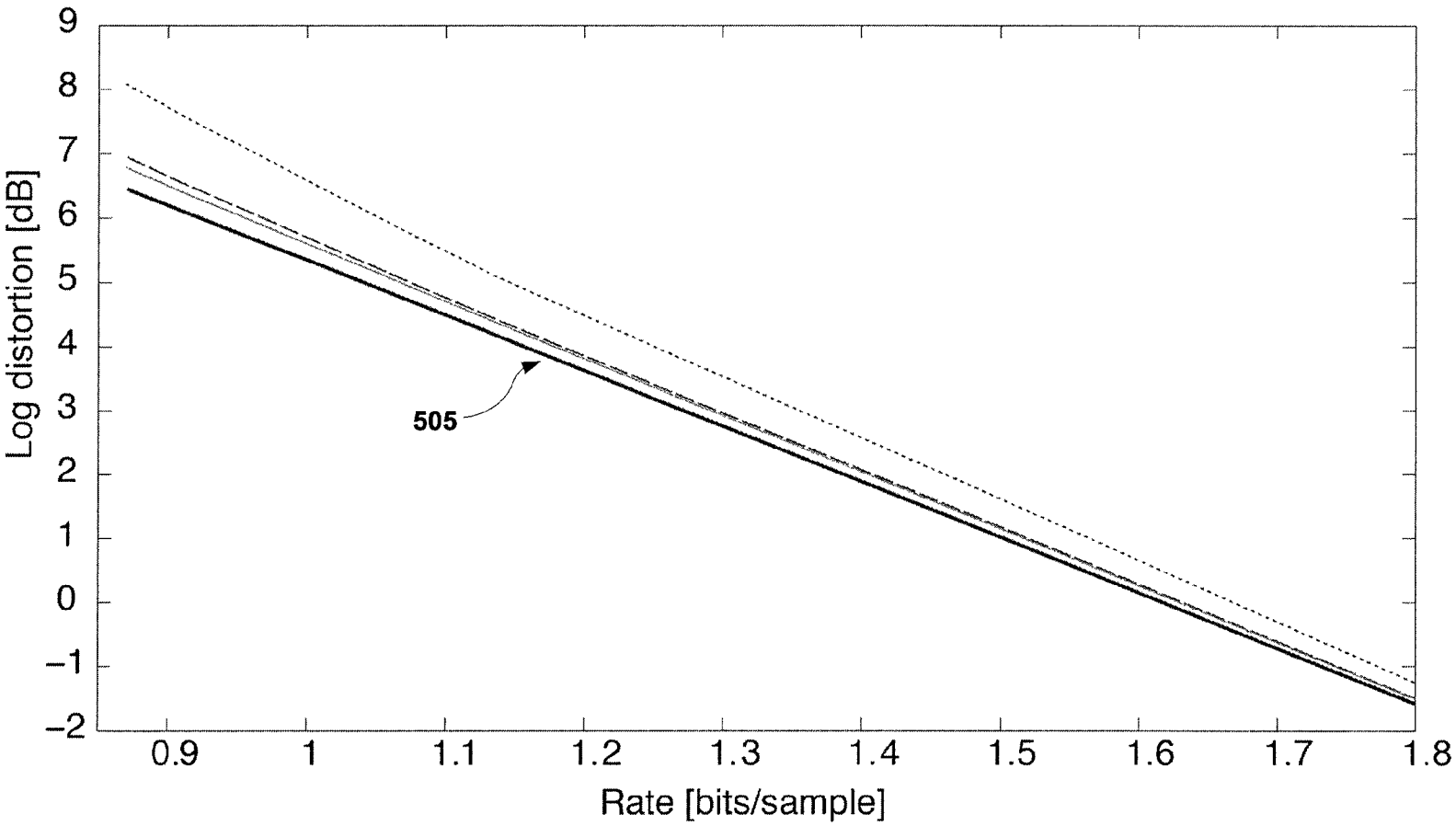
FIG. 5 is a graphical representation illustrating example performance for high rates using optimal pre- and post-filters according to one or more embodiments described herein.

The first experiment uses all-zero filters (20) as given by equation (32) in Appendix A, which is optimal for the AR process at high rates (e.g., $\lambda \le S_X(e^{j\omega P})$ in equation (4)). The optimal filters need to have conjugate phase responses which is possible to implement using proper delay compensation. FIG. 5 presents the log distortion of four systems: no filtering, both pre- and post-filtering, and only pre- or post-filtering. The plots start at the rate where $\lambda = S_X(e^{j\omega P})$, which in the present example is 0.87 bits/sample. The bold, solid, lowermost curve 505 is the optimal performance using both filters and the other curves confirm the findings presented above in Section 3.1 that using only a post-filter is better than using only a pre-filter. As the rate increases, all the curves converge since the optimal filters converge to unity.

Figure 6:
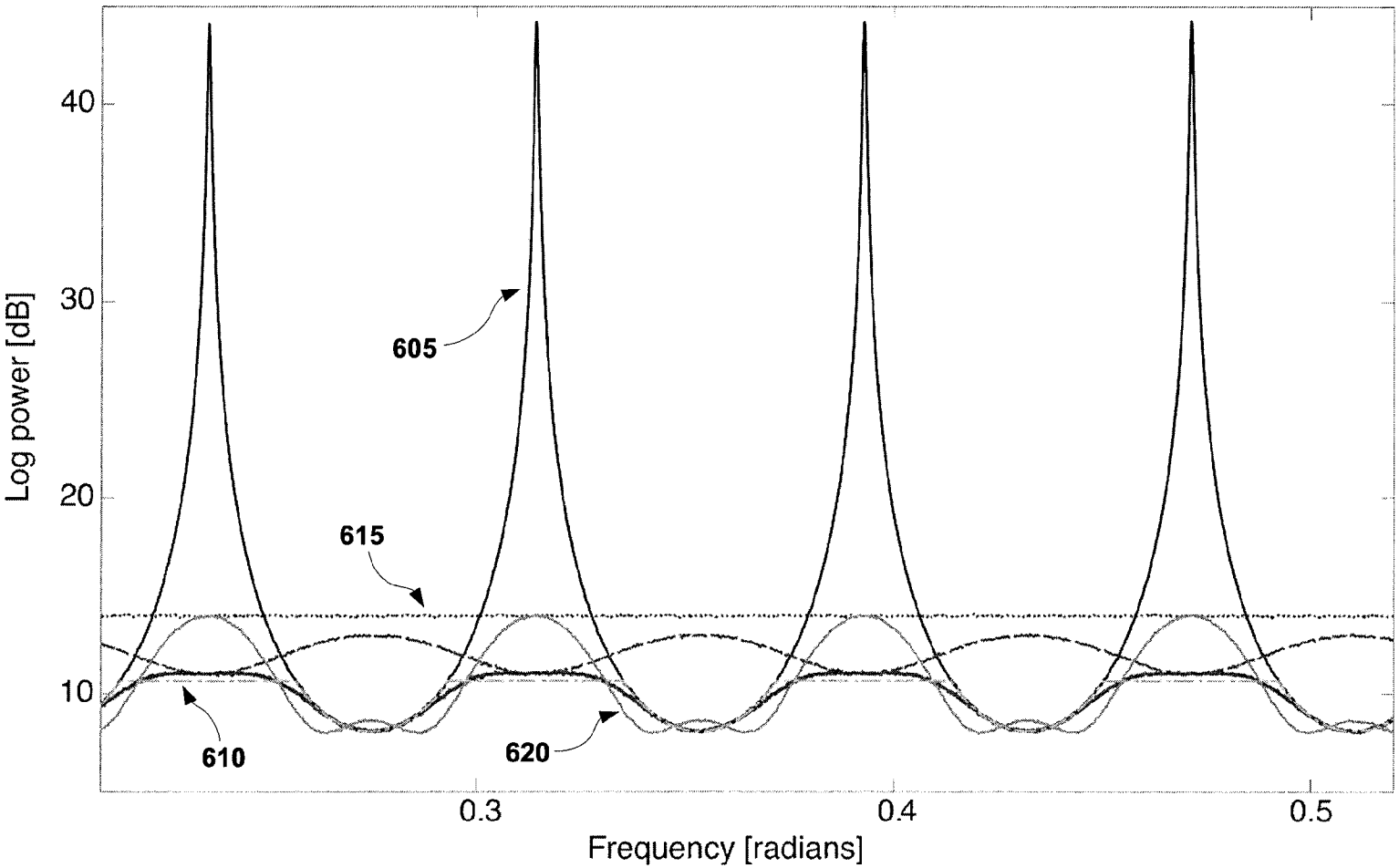
FIG. 6 is a graphical representation illustrating example signal and distortion spectra when coding an autoregressive process according to one or more embodiments described herein.

The second experiment uses paired-zero filters as described above in Section 4.1. For this example the parameters were selected as $\beta_0$=1, $\beta_1$=0.99, and $\omega_0$=0.15. FIG. 6 depicts signal and distortion spectra when coding the AR process at a low rate (e.g., 0.48 bits/sample). It should be noted that the spectra are only plotted for a part of the frequency range, and periodic resonances are visible at multiples of $$\frac{2\pi}{P}.$$

Referring to the example plot shown in FIG. 6, the solid curve 605 is the AR process spectrum and the dashed, dotted curve 610 is the optimal log distortion from equation (2). Using no filters yields the dotted flat curve 615, and having both pre- and post-filters results in the bold curve 620, which closely approximates optimal performance. The spectra corresponding to utilizing one filter only are also plotted and again a post-filter only is better than a pre-filter only. For at least this experiment, delay compensation was utilized to obtain distortion spectra.

Figure 7:
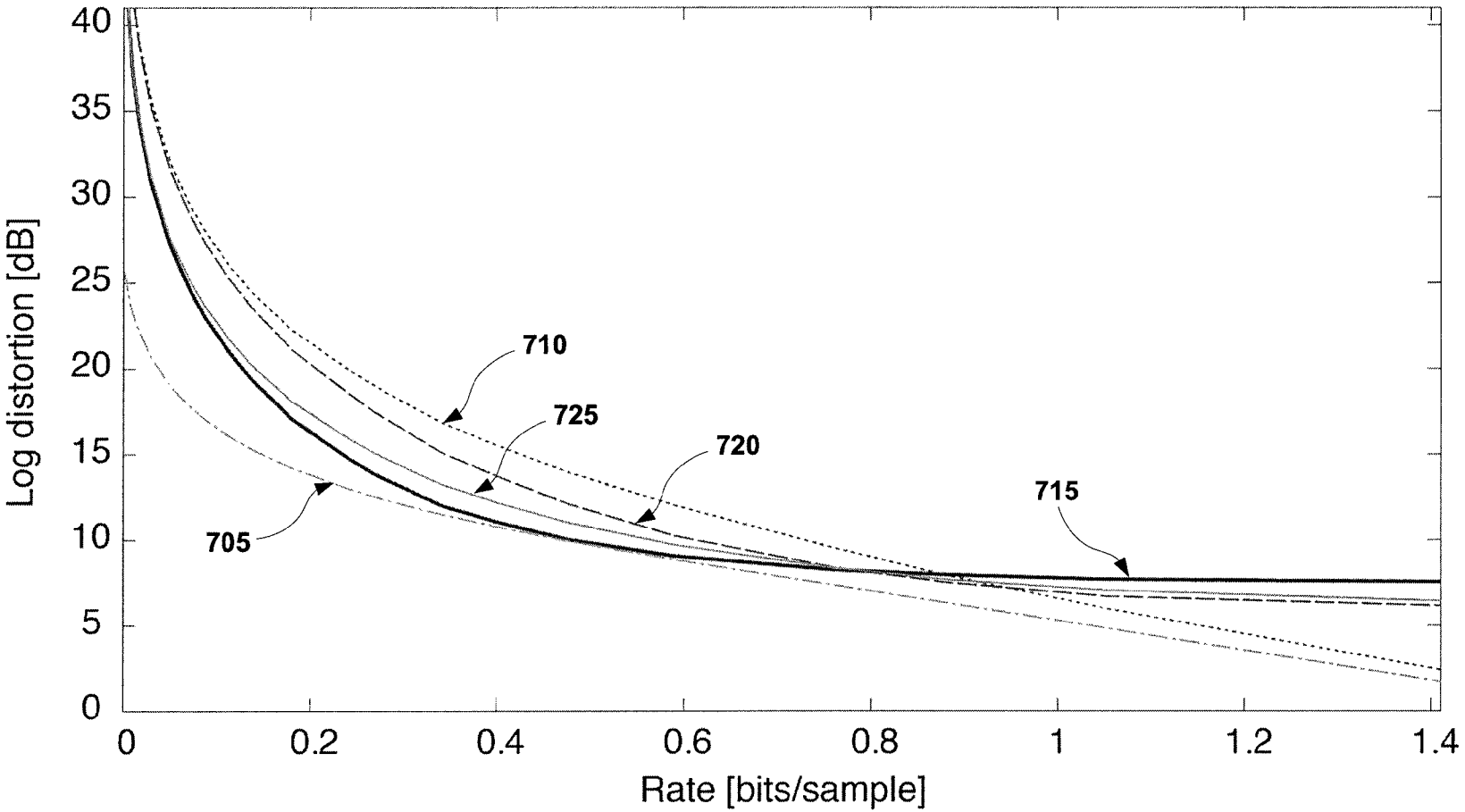
FIG. 7 is a graphical representation illustrating example performance for low rates using optimal pre- and post-filters according to one or more embodiments described herein.

FIG. 7 depicts the performance of the paired-zero filter configurations corresponding to the high rate results in FIG. 5. The example plot shows performance for the combinations of no pre- or post-filter 710, both pre- and post-filter 715, only pre-filter 720, only post-filter 725, and RD-optimal 705 from equation (2), described above. It can be seen that at rates between 0.4 and 0.6 bits/sample a pre- and post-filter combination reaches a nearly optimal performance. Again, a post-filter only setup performs better than a pre-filter only setup. When the rate increases, the paired-zero filters are clearly suboptimal.

5.2. Performance on Speech Data

In addition to the above experiments using artificial data, experiments were also performed on speech data. In the speech data experiments, the paired-zero post-filtering concept was applied to enhancing coded speech using the strategy proposed in method 4. described above in Section 4.1. For each block of speech the pitch was estimated and the set of filters defined, each having the same pitch, but with different cut-off frequencies for periodicity (for example, compare with the example filter responses illustrated in FIG. 4). The filter yielding the lowest value of the criterion in equation (27) was then selected and utilized as post-filter.

In the speech experiments, the following values were used: $\xi$=1.6, $\lambda$=0.3, and b=1. The post-filtering was applied to speech coded with the ITU-T G.722.1 codec at 16 kbps, the ITU-T G.722.2 (AMRWB) codec at 9 kbps and 16 kbps, and the iSAC codec at 16 kbps. A small listening test was then conducted in which six experienced listeners compared pairs of speech clips with and without post-filtering, and indicated their preference. The speech material consisted of six female sentences from two speakers and five male sentences from two speakers. Results from the listening test are presented in Table 1 below. It is clear from the results presented in Table 1 that post-filtering improves the subjective quality.

TABLE 1

| Codec | Pref. w/ Post-Filtering | Pref. w/o Post-Filtering |
|---|---|---|
| G.722.1-16 kbps | 83% | 17% |
| G.722.2-16 kbps | 75% | 25% |
| G.722.2-9 kbps | 88% | 12% |
| iSAC-16 kbps | 96% | 4% |

6. CONCLUSION

The present disclosure introduces new refinements for pitch prediction in speech and audio coding. It was theoretically shown in the above sections that post-filtering is more effective than pre-filtering. The experiments performed confirm this result, but also show that the difference can be small in absolute values. Furthermore, the present disclosure proposes a methodology to select or design post-filters that do not require a rate increase. In other words, the method uses only information available at the decoder.

The methods described herein were combined with a new paired-zero post-filter design for the low-rate regime, and the objective experiments performed show that this post-filter design can approximate the theoretically optimal post-filter well over a practically-important range of rates. Additionally, the subjective experiments performed show that the proposed methods have significant practical benefits.

Figure 8:
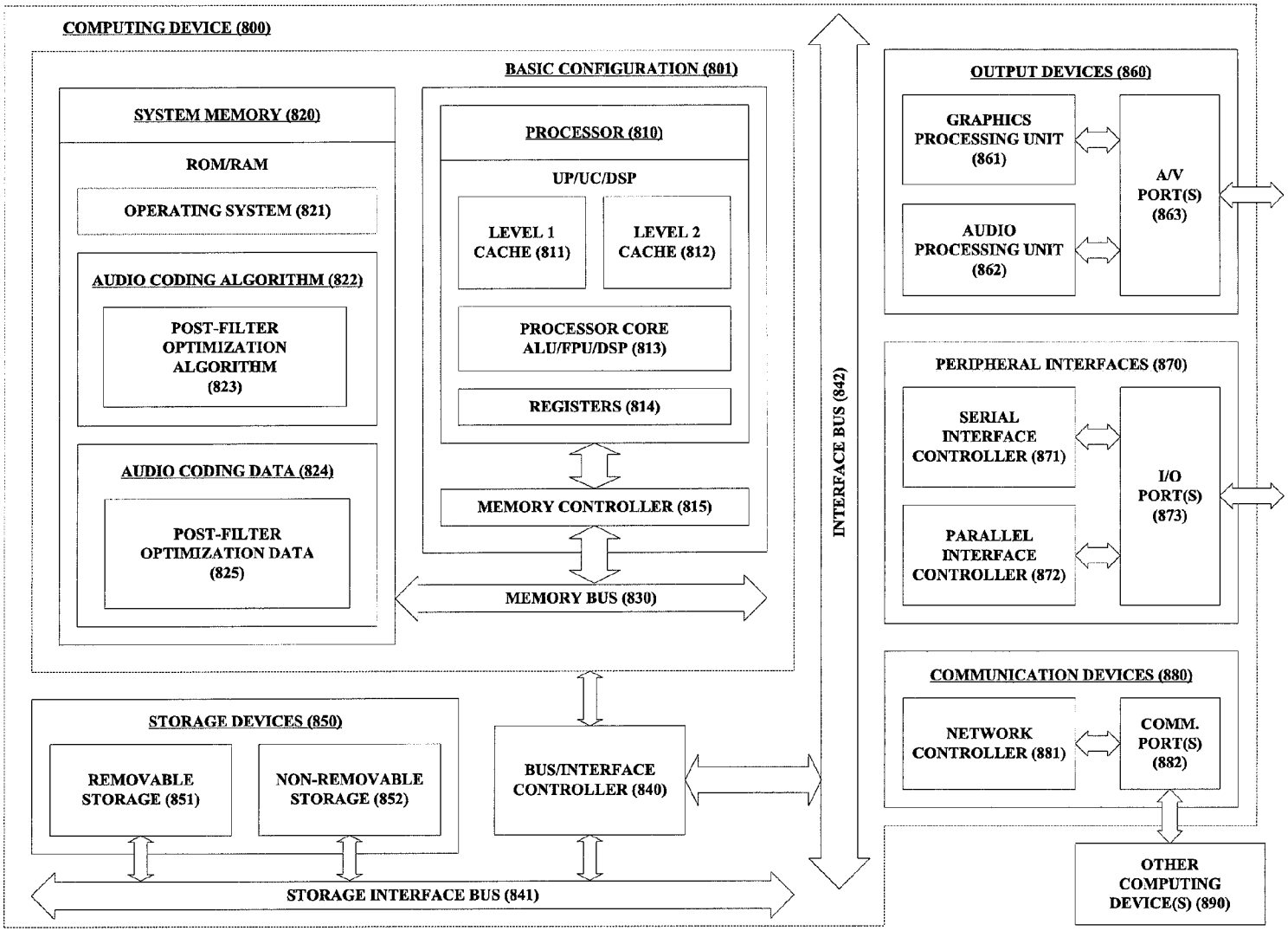
FIG. 8 is a block diagram illustrating an example computing device arranged for optimizing or selecting a post-filter without increasing rate according to one or more embodiments described herein.

FIG. 8 is a block diagram illustrating an example computing device 800 that is arranged for selecting, optimizing, and/or designing a post-filter that does not require a corresponding increase in rate, and executing/operating the resulting post-filter, in accordance with one or more embodiments of the present disclosure. In a very basic configuration 801, computing device 800 typically includes one or more processors 810 and system memory 820. A memory bus 830 may be used for communicating between the processor 810 and the system memory 820.

Depending on the desired configuration, processor 810 can be of any type including but not limited to a microprocessor (μP), a microcontroller (μC), a digital signal processor (DSP), or any combination thereof. Processor 810 may include one or more levels of caching, such as a level one cache 811 and a level two cache 812, a processor core 813, and registers 814. The processor core 813 may include an arithmetic logic unit (ALU), a floating point unit (FPU), a digital signal processing core (DSP Core), or any combination thereof. A memory controller 815 can also be used with the processor 810, or in some embodiments the memory controller 815 can be an internal part of the processor 810.

Depending on the desired configuration, the system memory 820 can be of any type including but not limited to volatile memory (e.g., RAM), non-volatile memory (e.g., ROM, flash memory, etc.) or any combination thereof. System memory 820 may include an operating system 821, one or more audio coding algorithms 822, and audio coding data 824. In at least some embodiments, audio coding algorithm 822 includes a post-filter optimization algorithm 823 that is configured to select or design a post-filter without increasing a corresponding rate. The audio coding algorithm 822 is configured to operate (e.g., execute, initiate, run, etc.) the resulting post-filter to enhance a reconstructed audio signal. The post-filter optimization algorithm 823 is further arranged to provide a general performance measure for a post-filter that only uses information available at relevant decoder. This criterion allows for the optimization or selection of a post-filter without the resulting rate increase.

Audio coding data 824 may include post-filter optimization data 825 that is useful for identifying post-filter designs and facilitating selection. In some embodiments, audio coding algorithm 822 can be arranged to operate with audio coding data 824 on an operating system 821 such that an optimal post-filter design can be selected without causing a corresponding rate increase.

Computing device 800 can have additional features and/or functionality, and additional interfaces to facilitate communications between the basic configuration 801 and any required devices and interfaces. For example, a bus/interface controller 840 can be used to facilitate communications between the basic configuration 801 and one or more data storage devices 850 via a storage interface bus 841. The data storage devices 850 can be removable storage devices 851, non-removable storage devices 852, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 820, removable storage 851 and non-removable storage 852 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media can be part of computing device 800.

Computing device 800 can also include an interface bus 842 for facilitating communication from various interface devices (e.g., output interfaces, peripheral interfaces, communication interfaces, etc.) to the basic configuration 801 via the bus/interface controller 840. Example output devices 860 include a graphics processing unit 861 and an audio processing unit 862, either or both of which can be configured to communicate to various external devices such as a display or speakers via one or more A/V ports 863. Example peripheral interfaces 870 include a serial interface controller 871 or a parallel interface controller 872, which can be configured to communicate with external devices such as input devices (e.g., keyboard, mouse, pen, voice input device, touch input device, etc.) or other peripheral devices (e.g., printer, scanner, etc.) via one or more I/O ports 873.

An example communication device 880 includes a network controller 881, which can be arranged to facilitate communications with one or more other computing devices 890 over a network communication (not shown) via one or more communication ports 882. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 800 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 800 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency trade-offs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

APPENDIX A

Optimal Pitch Post-Filter and Pre-Filter

The response of equation (4) follows from equations (1) and (3). For the high-rate regime, this gives the following:

$$|H(e^{j\omega})|^2 = 1 - \frac{\lambda}{\sigma^2}(1 + \alpha^2 - 2\alpha\cos(\omega P)) \tag{28}$$

$$= \frac{\lambda}{\sigma^2}\gamma\left(\frac{1}{\gamma}\frac{\sigma^2}{\gamma} - \frac{1}{\gamma} - \frac{\alpha^2}{\gamma} - \frac{\alpha^2}{\gamma^2} + \frac{\alpha^2}{\gamma^2} + 2\frac{\alpha}{\gamma}\cos(\omega P)\right). \tag{29}$$

$$= \frac{\lambda}{\sigma^2}\gamma\left(1 + \frac{\alpha^2}{\gamma^2} + 2\frac{\alpha}{\gamma}\cos(\omega P)\right) \tag{30}$$

$$= \frac{\lambda}{\sigma^2}\gamma\left|1 + \frac{\alpha}{\gamma}e^{-j\omega P}\right|^2 \tag{31}$$

where the steps (29) and (30) assumes that there exists a real, positive $\gamma$ that solves $$1 = \frac{1}{\gamma}\frac{\sigma^2}{\lambda} - \frac{1}{\gamma} - \frac{\alpha^2}{\gamma} - \frac{\alpha^2}{\gamma^2}.$$

It is assumed that $\alpha \geq 0$. Expression (31) then follows from the Fejer-Riesz theorem that this is possible if the expression (28) is non-negative (if $$\frac{\sigma^2}{\lambda} - 1 - \alpha^2 \geq 2\alpha\Big).$$

It is necessary to determine a real root of the polynomial $$\gamma^2 - \gamma\left(\frac{\sigma^2}{\lambda} - 1 - \alpha^2\right) + \alpha^2.$$

The root exists for $$\frac{\sigma^2}{\lambda} - 1 - \alpha^2 \geq 2\alpha,$$

and the minimum-phase solution is:

$$\gamma = \frac{1}{2}\left(\left(\frac{\sigma^2}{\lambda} - 1 - \alpha^2\right) + \sqrt{\left(\frac{\sigma^2}{\lambda} - 1 - \alpha^2\right)^2 - 4\alpha^2}\right) \tag{32}$$

The zeros of the optimal solution of (32) are interlaced with the poles of the transfer function in (1).

APPENDIX B

Optimal Coefficients for the Paired-Zero Post-Filter

The frequency response of the post-filter may be denoted by $f(e^{-j\omega}, \theta)$, where $\theta$ are parameters specifying the filter. The objective is then to minimize the following:

$$\eta = \frac{1}{2\pi}\int_{-\pi}^{\pi} S_X(e^{-j\omega})|1 - f(e^{-j\omega}, \theta)|^2 + \lambda|f(e^{-j\omega}, \theta)|^2\, d\omega \tag{33}$$

where the first term in the argument of the integral is signal distortion, and the second term is the noise remaining after the post-filter. If the filter is non-parametric, then the minimization of $\eta$ leads to a Wiener filter. However, here we constrain the filter to have the paired-zero form $$f(e^{-j\omega},\theta) = \beta_0(1-\beta_1 e^{j\omega_0}e^{-j\omega P})(1-\beta_1 e^{-j\omega_0}e^{-j\omega P}) \tag{34}$$

where $\upsilon = e^{-j\omega_0}$ and $\theta = \{\beta_0, \beta_0, \omega_0\}$. The integral in (33) can be performed analytically for the choice of (34) and (1), for f and $S_X$, respectively. The resulting expression for $\eta$ is real and is a quartic polynomial in $\beta_1$, which can, in principle, be solved analytically for given $\omega_0$ and $\beta_0$. In practice, numerical root-solvers may be more convenient for this purpose, and a grid search over $\omega_0$ and $\beta_0$ can be used to find a numerical solution for the triple $\{\beta_0, \beta_1, \omega_0\}$.

We claim:

1. A method for determining parameters of a post-filter for a segment of decoded audio, the method comprising:

applying a post-filter to a segment of decoded audio;

decomposing signal error for the segment of decoded audio into a signal-correlated distortion component and a signal-uncorrelated noise component; and evaluating a criterion that weighs an increase of the signal-correlated distortion component against a reduction in the signal-uncorrelated noise component.

2. The method of claim 1, further comprising, prior to applying the post-filter, computing the signal-correlated distortion component and the signal-uncorrelated noise component from the reconstructed signal and a hypothesized level of quantization noise.

3. The method of claim 2, wherein the hypothesized level of the quantization noise is computed based on a signal-to-quantization-noise ratio.

4. The method of claim 1, further comprising computing the signal-correlated distortion component and the signal-uncorrelated noise component from transmitted model parameters and a hypothesized level of quantization noise.

5. The method of claim 4, wherein the hypothesized level of the quantization noise is computed based on a signal-to-quantization-noise ratio.

6. The method of claim 1, wherein the signal-correlated distortion component and the signal-uncorrelated noise component are computed directly from the segment of decoded audio in the frequency domain.

7. The method of claim 1, wherein the criterion is evaluated separately for a set of frequency bands, each of the frequency bands having its own hypothesized level of quantization noise, and wherein the overall criterion is based on the criteria computed for the set of frequency bands.

8. The method of claim 7, wherein each of the hypothesized levels of the quantization noise is computed based on a signal-to-quantization-noise ratio.

9. The method of claim 1, wherein the post-filter is implemented as an all-zero filter that has a pair of zeros being symmetrically placed around the midpoint of each pole of a one-tap all-pole or a virtual one-tap all-pole model of the periodicity of the signal.

10. A method for enhancing periodicity of an audio signal, the method comprising:

generating a first component by filtering an audio signal using a concatenation of a post-filter and a second filter with a gain representing a periodicity enhancement contour, said concatenation having a first delay;

generating a second component by filtering the audio signal using the complement of the second filter with delay compensation matching the first delay; and computing a post-filter by adding the first component and the second component.

* * * * *